US010426250B2

(12) United States Patent
Jimenez et al.

(10) Patent No.: US 10,426,250 B2
(45) Date of Patent: Oct. 1, 2019

(54) ORAL CARE IMPLEMENT

(71) Applicant: Colgate-Palmolive Company, New York, NY (US)

(72) Inventors: Eduardo Jimenez, Manalapan, NJ (US); Kenneth Waguespack, North Brunswick, NJ (US); Robert Moskovich, East Brunswick, NJ (US); Andreas Wechsler, Zell am See (AT); Joachim Storz, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 293 days.

(21) Appl. No.: 15/539,378

(22) PCT Filed: Dec. 23, 2014

(86) PCT No.: PCT/US2014/072052
§ 371 (c)(1),
(2) Date: Jun. 23, 2017

(87) PCT Pub. No.: WO2016/105361
PCT Pub. Date: Jun. 30, 2016

(65) Prior Publication Data

US 2017/0360186 A1 Dec. 21, 2017

(51) Int. Cl.
*A46B 9/04* (2006.01)
*A46B 9/02* (2006.01)

(52) U.S. Cl.
CPC ..... *A46B 9/04* (2013.01); *A46B 9/025* (2013.01); *A46B 9/028* (2013.01); *A46B 2200/1066* (2013.01)

(58) Field of Classification Search
CPC ..... A46B 15/0016; A46B 9/028; A46B 9/02; A46B 9/04; A46B 9/025; A46B 2200/1066
See application file for complete search history.

(56) References Cited

U.S. PATENT DOCUMENTS 758,764 A 5/1904 MacLeod
846,900 A 3/1907 Bloom
(Continued)

FOREIGN PATENT DOCUMENTS

AR 71556 10/2003
AR 80042 11/2009
(Continued)

OTHER PUBLICATIONS

International Search Report and the Written Opinion issued in International Application PCT/US2010/046806 dated Mar. 16, 2011.
(Continued)

*Primary Examiner* — Shay Karls

(57) ABSTRACT

An oral care implement that includes a conical tuft of bristles. In one embodiment, the invention is an oral care implement that includes a handle and a head coupled to the handle, the head having a front surface. A plurality of tooth cleaning elements extend from the front surface of the head. The plurality of tooth cleaning elements include a conical tuft that has a bristle wall having an inner surface defining a cavity, the cavity having a transverse cross-sectional area that increases with distance from the front surface of the head. Furthermore, in some embodiments the bristle wall terminates in an annular top surface that is inclined relative to the front surface of the head. In some embodiments, the head includes more than one of the conical tufts, such as two of the conical tufts or four of the conical tufts.

20 Claims, 8 Drawing Sheets

(56) References Cited

U.S. PATENT DOCUMENTS 1,125,532 A 1/1915 Himmel
1,901,230 A * 3/1933 Palmer ..... A46B 9/04 15/167.1
1,924,152 A 8/1933 Coney et al.
2,161,349 A 6/1939 Hadden
2,186,005 A 1/1940 Casto
2,305,461 A * 12/1942 Spyra ..... A46B 9/04 15/167.1
D273,635 S * 5/1984 Stocchi ..... D4/104
4,517,701 A 5/1985 Stanford, Jr.
4,958,402 A 9/1990 Weihrauch
5,144,712 A 9/1992 Hansel et al.
5,339,482 A 8/1994 Desimone et al.
5,392,483 A 2/1995 Heinzelman et al.
5,584,690 A 12/1996 Maassarani
5,604,951 A 2/1997 Shipp
5,628,082 A 5/1997 Moskovich
5,651,158 A 7/1997 Halm
D390,706 S 2/1998 Hohlbein et al.
5,735,012 A 4/1998 Heinzelman et al.
5,746,532 A 5/1998 Megill et al.
5,758,383 A 6/1998 Hohlbein
5,781,958 A 7/1998 Meessmann et al.
5,799,353 A 9/1998 Yamamoto et al.
5,802,656 A 9/1998 Dawson et al.
5,839,149 A 11/1998 Scheier et al.
D404,205 S 1/1999 Hohlbein
D404,206 S 1/1999 Hohlbein
5,862,559 A 1/1999 Hunter
5,863,102 A 1/1999 Waguespack et al.
5,908,038 A 6/1999 Bennett
5,915,868 A 6/1999 Frazell
5,930,860 A 8/1999 Shipp
5,946,758 A 9/1999 Hohlbein et al.
5,967,152 A 10/1999 Rimkus
5,970,564 A 10/1999 Inns et al.
5,984,935 A 11/1999 Budei et al.
5,991,958 A 11/1999 Hohlbein
6,015,293 A 1/2000 Rimkus
6,032,313 A 3/2000 Tsang
6,041,468 A 3/2000 Chen et al.
6,073,299 A 6/2000 Hohlbein
6,088,870 A 7/2000 Hohlbein
D429,887 S 8/2000 Hohlbein et al.
6,099,780 A 8/2000 Gellert
6,131,228 A 10/2000 Chen et al.
6,178,583 B1 1/2001 Volpenhein
6,234,798 B1 5/2001 Salazar et al.
6,272,714 B2 8/2001 Beals
6,276,021 B1 8/2001 Hohlbein
6,292,973 B1 9/2001 Moskovich et al.
D450,457 S 11/2001 Hohlbein
D450,929 S 11/2001 Angelini et al.
6,314,606 B1 11/2001 Hohlbein
D451,286 S 12/2001 Hohlbein
D456,138 S 4/2002 Hohlbein
D456,139 S 4/2002 Hohlbein
6,370,726 B1 4/2002 Kini et al.
D457,323 S 5/2002 Hohlbein
6,397,425 B1 6/2002 Szczech et al.
6,408,476 B1 6/2002 Cann
6,421,867 B1 7/2002 Weihrauch
D461,313 S 8/2002 Hohlbein
6,442,786 B2 9/2002 Halm
6,442,787 B2 9/2002 Hohlbein
D464,133 S 10/2002 Barnett et al.
6,463,618 B1 10/2002 Zimmer
D474,608 S 5/2003 Hohlbein
6,564,416 B1 5/2003 Claire et al.
6,596,213 B2 6/2003 Swenson
6,595,087 B2 7/2003 Whalen et al.
6,599,048 B2 7/2003 Kuo
6,601,272 B2 8/2003 Stvartak et al.
6,658,688 B2 12/2003 Gavney, Jr.
D486,649 S 2/2004 Sprosta et al.
6,687,940 B1 2/2004 Gross et al.
6,749,788 B1 6/2004 Holden et al.
6,766,549 B2 7/2004 Klupt
6,792,642 B2 9/2004 Wagstaff
6,820,299 B2 11/2004 Gavney, Jr.
6,820,300 B2 11/2004 Gavney, Jr.
6,859,969 B2 3/2005 Gavney, Jr. et al.
D503,538 S 4/2005 Desalvo
6,886,207 B1 5/2005 Solanki
6,889,405 B2 5/2005 Ritrovato et al.
6,919,038 B2 7/2005 Meyer et al.
6,957,469 B2 10/2005 Davies
D511,249 S 11/2005 Hohlbein
6,972,106 B2 12/2005 Huber et al.
D513,882 S 1/2006 Hohlbein et al.
6,983,507 B2 1/2006 McDougall
D514,320 S 2/2006 Hohlbein
D514,812 S 2/2006 Hohlbein et al.
6,996,870 B2 2/2006 Hohlbein
D516,819 S 3/2006 Hohlbein
D517,812 S 3/2006 Hohlbein et al.
D517,813 S 3/2006 Hohlbein et al.
7,007,332 B2 3/2006 Hohlbein
7,020,928 B2 4/2006 Hohlbein
D520,753 S 5/2006 Hohlbein
7,047,591 B2 5/2006 Hohlbein
7,069,615 B2 7/2006 Gavney, Jr.
7,073,225 B1 7/2006 Ford
D526,487 S 8/2006 Chenvainu et al.
7,083,756 B2 8/2006 Strahler
7,089,621 B2 8/2006 Hohlbein
D527,528 S 9/2006 Hohlbein
D528,803 S 9/2006 Hohlbein
D532,202 S 11/2006 Hohlbein
D532,607 S 11/2006 Hohlbein
7,143,462 B2 12/2006 Hohlbein
7,146,675 B2 12/2006 Ansari et al.
7,168,125 B2 1/2007 Hohlbein
7,181,799 B2 2/2007 Gavney, Jr. et al.
7,182,542 B2 2/2007 Hohlbein
7,213,288 B2 5/2007 Hohlbein
7,219,384 B2 5/2007 Hohlbein
7,273,327 B2 9/2007 Hohlbein et al.
D557,504 S 12/2007 Hohlbein
D557,505 S 12/2007 Hohlbein
7,322,067 B2 1/2008 Hohlbein
D562,560 S 2/2008 Hohlbein
7,331,731 B2 2/2008 Hohlbein et al.
7,354,112 B2 4/2008 Fischer et al.
7,383,619 B2 6/2008 Gross et al.
7,386,909 B2 6/2008 Hohlbein
7,415,788 B2 8/2008 Little
7,458,125 B2 12/2008 Hohlbein
7,472,448 B2 1/2009 Hohlbein et al.
7,478,959 B2 1/2009 Hohlbein
7,480,955 B2 1/2009 Hohlbein et al.
D589,260 S 3/2009 Hohlbein
7,540,844 B2 6/2009 Muser
D598,199 S 8/2009 Russell et al.
D598,654 S 8/2009 Huang
D599,556 S 9/2009 Russell et al.
7,614,111 B2 11/2009 Moskovich et al.
D609,915 S 2/2010 Erskine-Smith et al.
D612,611 S 3/2010 Brown, Jr. et al.
7,712,175 B2 5/2010 Blanchard et al.
7,721,376 B2 5/2010 Hohlbein et al.
7,722,274 B2 5/2010 Hohlbein et al.
7,735,174 B2 6/2010 Hohlbein et al.
D623,415 S 9/2010 Geiberger
7,788,756 B2 9/2010 Kraemer
7,845,042 B2 12/2010 Moskovich et al.
7,854,036 B2 12/2010 Georgi
7,937,794 B2 5/2011 Huber et al.
7,954,191 B2 6/2011 Hohlbein
7,958,589 B2 6/2011 Braun et al.
7,975,343 B2 7/2011 Hohlbein et al.
7,975,346 B2 7/2011 Moskovch et al.
7,979,947 B2 7/2011 Storkel et al.
8,032,991 B2 10/2011 Lawless

(56) References Cited

U.S. PATENT DOCUMENTS

| | | | |
|---|---|---|---|
| 8,042,217 | B2 | 10/2011 | Sorrentino |
| 8,046,864 | B2 | 11/2011 | Baertschi et al. |
| 8,060,972 | B2 | 11/2011 | Geiberger et al. |
| 8,083,980 | B2 | 12/2011 | Huber et al. |
| 8,239,996 | B2 | 8/2012 | Garber et al. |
| 8,307,488 | B2 | 11/2012 | Pfenniger et al. |
| 8,327,492 | B2 | 12/2012 | Cann |
| 8,332,982 | B2 | 12/2012 | Braun et al. |
| 8,332,985 | B2 | 12/2012 | Solanki |
| 8,382,208 | B2 | 2/2013 | Baertschi et al. |
| 8,448,284 | B2 | 5/2013 | Gross et al. |
| 8,448,287 | B2 | 5/2013 | Ponzini et al. |
| 8,458,846 | B2 | 6/2013 | Schamberg et al. |
| 8,484,789 | B2 | 7/2013 | Claire-Zimmet et al. |
| 8,500,766 | B2 | 8/2013 | Jimenez et al. |
| 8,528,148 | B2 | 9/2013 | Brown, Jr. et al. |
| 8,595,886 | B2 | 12/2013 | Edelstein et al. |
| 8,601,635 | B2 | 12/2013 | Goldman et al. |
| 8,608,251 | B2 | 12/2013 | Nirwing et al. |
| 8,621,698 | B2 | 1/2014 | Chenvainu et al. |
| 8,631,534 | B2 | 1/2014 | Blanchard et al. |
| 8,732,890 | B2 | 5/2014 | Mohr et al. |
| 8,739,351 | B2 | 6/2014 | Kling et al. |
| 8,776,302 | B2 | 7/2014 | Baertschi et al. |
| 8,813,292 | B2 | 8/2014 | Driesen et al. |
| 2002/0017003 | A1 | 2/2002 | Kramer et al. |
| 2002/0138928 | A1 | 10/2002 | Calabrese |
| 2003/0163881 | A1 | 9/2003 | Driesen et al. |
| 2003/0178745 | A1 | 9/2003 | Scarabelli et al. |
| 2003/0178885 | A1 | 9/2003 | Weihrauch |
| 2004/0025275 | A1 | 2/2004 | Moskovich et al. |
| 2004/0107521 | A1 | 6/2004 | Chan et al. |
| 2004/0134007 | A1 | 7/2004 | Davies |
| 2005/0000048 | A1 | 1/2005 | Hohlbein |
| 2005/0166343 | A1 | 8/2005 | Gavney, Jr. |
| 2005/0210612 | A1 | 9/2005 | Hohlbein et al. |
| 2006/0048314 | A1 | 3/2006 | Kressner |
| 2006/0048323 | A1 | 3/2006 | Rueb |
| 2006/0064827 | A1 | 3/2006 | Chan |
| 2006/0123574 | A1 | 6/2006 | Storkel et al. |
| 2006/0236477 | A1 | 10/2006 | Gavney, Jr. |
| 2006/0236478 | A1 | 10/2006 | Hohlbein et al. |
| 2006/0248667 | A1 | 11/2006 | Kraemer |
| 2007/0151058 | A1 | 7/2007 | Kraemer et al. |
| 2007/0169295 | A1 | 7/2007 | Winter et al. |
| 2007/0265555 | A1 | 11/2007 | Deng |
| 2007/0283517 | A1 | 12/2007 | Blanchard et al. |
| 2009/0007357 | A1 | 1/2009 | Meadows et al. |
| 2009/0025165 | A1 | 1/2009 | Mokovich et al. |
| 2009/0038097 | A1 | 2/2009 | Geiberger |
| 2009/0064435 | A1 | 3/2009 | Fukugaki et al. |
| 2009/0158543 | A1 | 6/2009 | Lee |
| 2009/0255077 | A1 | 10/2009 | Mori et al. |
| 2010/0043162 | A1 | 2/2010 | Kling et al. |
| 2010/0058550 | A1 | 3/2010 | Ballmaier et al. |
| 2010/0088836 | A1 | 4/2010 | Kirchhofer et al. |
| 2010/0101037 | A1 | 4/2010 | Hilfiker et al. |
| 2010/0115724 | A1 | 5/2010 | Huang |
| 2010/0180392 | A1 | 7/2010 | Binet et al. |
| 2010/0223746 | A1 | 9/2010 | Mueller |
| 2010/0263149 | A1 | 10/2010 | Ballmaier et al. |
| 2010/0306941 | A1 | 12/2010 | Erskine-Smith et al. |
| 2011/0030160 | A1 | 2/2011 | Knutzen et al. |
| 2011/0047736 | A1* | 3/2011 | Jimenez ..... A46B 9/04 15/167.2 |
| 2011/0138560 | A1 | 6/2011 | Vitt et al. |
| 2011/0219558 | A1 | 9/2011 | Vitt et al. |
| 2011/0109149 | A1 | 12/2011 | Loetscher et al. |
| 2012/0034576 | A1 | 2/2012 | Mostafa |
| 2012/0192369 | A1 | 8/2012 | Mohr et al. |
| 2013/0007968 | A1 | 1/2013 | Driesen et al. |
| 2013/0036566 | A1 | 2/2013 | Schlatter |
| 2013/0139338 | A1 | 6/2013 | Hess et al. |
| 2013/0269128 | A1 | 10/2013 | Jimenez |
| 2013/0291320 | A1 | 11/2013 | Kirchhofer et al. |
| 2013/0333126 | A1 | 12/2013 | Miller |
| 2014/0047656 | A1 | 2/2014 | Newman et al. |
| 2014/0158152 | A1 | 6/2014 | Kirchhofer et al. |
| 2014/0173838 | A1 | 6/2014 | Dickie et al. |
| 2014/0173853 | A1 | 6/2014 | Kirchhofer et al. |
| 2014/0298605 | A1 | 10/2014 | Ivory |
| 2014/0310901 | A1 | 10/2014 | Geiberger et al. |
| 2015/0327666 | A1 | 11/2015 | Hohlbein |

FOREIGN PATENT DOCUMENTS

| | | | |
|---|---|---|---|
| BR | 7900283 | | 8/2000 |
| BR | 6601454-9 | | 4/2006 |
| BR | 6702593 | | 8/2007 |
| BR | 6805210-3 | | 11/2008 |
| BR | 6902120-1 | | 5/2009 |
| BR | 6903329-3 | | 8/2009 |
| BR | 6903330-7 | | 8/2009 |
| BR | 6904386 | | 11/2009 |
| BR | 7102178-7 | | 4/2011 |
| BR | 30 2013 000448-1 | | 2/2013 |
| BR | 6401609-9 | | 5/2014 |
| CH | 215110 | | 6/1941 |
| CN | 3372860 | | 6/2004 |
| CN | 3372861 | | 6/2004 |
| CN | 2732059 | | 10/2005 |
| CN | 300704339 | | 10/2007 |
| CN | 201294969 | | 8/2009 |
| CN | 201518876 | | 7/2010 |
| CN | 201518877 | | 7/2010 |
| CN | 201518880 | | 7/2010 |
| CN | 201528796 | | 7/2010 |
| CN | 201541995 | | 8/2010 |
| CN | 201541996 | | 8/2010 |
| CN | 201541997 | | 8/2010 |
| CN | 201550827 | | 8/2010 |
| CN | 301406316 | S | 12/2010 |
| CN | 301421505 | S | 12/2010 |
| CN | 201814085 | | 5/2011 |
| CN | 201986933 | | 9/2011 |
| CN | 301763519 | | 12/2011 |
| CN | 30198826 | | 5/2012 |
| CN | 302058056 | | 9/2012 |
| CN | 302225957 | S | 12/2012 |
| CN | 302328863 | S | 2/2013 |
| CN | 202800555 | | 3/2013 |
| CN | 103005839 | | 4/2013 |
| CN | 203194906 | | 9/2013 |
| CN | 203220069 | | 10/2013 |
| CN | 203220073 | | 10/2013 |
| CN | 203252150 | | 10/2013 |
| CN | 302956580 | S | 10/2014 |
| DE | 19858102 | | 6/2000 |
| DE | 202005009026 | | 10/2005 |
| DE | 102006016939 | | 5/2007 |
| DE | 102006005616 | | 8/2007 |
| DE | 102006024874 | | 11/2007 |
| DE | 202008016004 | | 2/2009 |
| DE | 102014002960 | | 9/2014 |
| EM | 000366984-0001 | | 7/2005 |
| EM | 000638028-0002 | | 12/2006 |
| EM | 001975079-0005 | | 1/2012 |
| EM | 002163675-0002 | | 1/2013 |
| EM | 002163675-0003 | | 1/2013 |
| EM | 002212522-0004 | | 4/2013 |
| EM | 002212522-0012 | | 4/2013 |
| EM | 002424069-0001 | | 3/2014 |
| EP | 0716821 | | 6/1996 |
| EP | 0769920 | | 9/2003 |
| EP | 2810581 | | 12/2014 |
| ES | 1063617 | | 11/2006 |
| IT | 2010P000035-0019 | | 10/2014 |
| JP | H08164025 | | 6/1996 |
| JP | 10042957 | | 8/1996 |
| JP | 1314270 | | 10/2007 |
| KR | 20040032038 | | 4/2004 |
| KR | 838174 | | 6/2007 |
| KR | 20-2012-0005449 | | 7/2012 |
| MX | 32553 | | 11/2009 |

(56) References Cited

FOREIGN PATENT DOCUMENTS

| | | |
|---|---|---|
| MX | 36113 | 4/2011 |
| MX | 36650 | 4/2011 |
| RU | 55985 | 1/2005 |
| RU | 79787 | 10/2011 |
| RU | 80086 | 11/2011 |
| RU | 81915 | 6/2012 |
| WO | WO1995/06420 | 3/1995 |
| WO | WO1995/10959 | 4/1995 |
| WO | WO1999/023910 | 5/1999 |
| WO | WO1999/55514 | 11/1999 |
| WO | WO1999/65358 | 12/1999 |
| WO | WO2000/49911 | 8/2000 |
| WO | WO2001/17392 | 3/2001 |
| WO | WO2001/29128 | 4/2001 |
| WO | WO2001/45573 | 6/2001 |
| WO | WO2001/182741 | 11/2001 |
| WO | WO2004/043669 | 5/2004 |
| WO | WO2005/122827 | 12/2005 |
| WO | WO2008/017996 | 2/2008 |
| WO | WO2011/070549 | 6/2011 |
| WO | WO2012/017923 | 2/2012 |
| WO | WO2012/115035 | 8/2012 |
| WO | WO2012/176741 | 12/2012 |
| WO | WO2013/031685 | 3/2013 |

OTHER PUBLICATIONS

International Search Report and the Written Opinion issued in International Application PCT/US2012/070760 dated Oct. 14, 2013.
International Search Report and the Written Opinion issued in International Application PCT/US2014/072052 dated Nov. 19, 2015.

* cited by examiner

ORAL CARE IMPLEMENT

BACKGROUND

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process, the industry continues to pursue arrangements of cleaning elements that will improve upon the existing technology. In typical oral care implements, bristles having circular transverse cross-sectional profiles are bundled together in a bristle tuft and mounted within tuft holes having circular transverse cross-sectional profiles. However, such a configuration results in gaps being present between adjacent bristles in the tuft and between the bristles of the tuft and the walls of the tuft holes, thereby resulting in a looser packing of the tuft hole and a less than optimal packing factor. These gaps can also reduce the effectiveness of the oral care implement and can cause the oral care implement to effectuate an uncomfortable feeling during brushing. Therefore, a need exists for an oral care implement having an improved arrangement of bristles.

BRIEF SUMMARY

The present invention is directed to an oral care implement that includes a handle and a head with a front surface. A plurality of tooth cleaning elements extend from the front surface of the head. The plurality of tooth cleaning elements include a conical tuft that has a bristle wall having an inner surface defining a cavity, the cavity having a transverse cross-sectional area that increases with distance from the front surface of the head. Furthermore, in some embodiments the bristle wall terminates in an annular top surface that is inclined relative to the front surface of the head. In some embodiments, the head includes more than one of the conical tufts, such as two of the conical tufts or four of the conical tufts.

In one aspect, the invention can be an oral care implement comprising: a handle; a head coupled to the handle, the head comprising a front surface and a longitudinal axis that extends from a proximal end of the head to a distal end of the head; a plurality of tooth cleaning elements extending from the front surface of the head; the plurality of tooth cleaning elements comprising a first conical tuft comprising a first bristle wall having an inner surface defining a first cavity along a first cavity axis, the first cavity having a transverse cross-sectional area that increases with distance from the front surface of the head, wherein the first bristle wall of the first conical tuft terminates in a first annular top surface that is inclined relative to the front surface from a first high point to a first low point; the plurality of tooth cleaning elements comprising a second conical tuft comprising a second bristle wall having an inner surface defining a second cavity along a second cavity axis, the second cavity having a transverse cross-sectional area that increases with distance from the front surface of the head, wherein the second bristle wall of the second conical tuft terminates in a second annular top surface that is inclined relative to the front surface from a second high point to a second low point; and the first and second conical tufts arranged on the head such that the first and second high points are adjacent to one another.

In another aspect, the invention can be an oral care implement comprising: a handle; a head coupled to the handle, the head comprising a front surface and a longitudinal axis that extends from a proximal end of the head to a distal end of the head; a plurality of tooth cleaning elements extending from the front surface of the head; the plurality of tooth cleaning elements comprising a first conical tuft comprising a first bristle wall having an inner surface defining a first cavity along a first cavity axis, the first cavity having a transverse cross-sectional area that increases with distance from the front surface of the head; the plurality of tooth cleaning elements comprising a second conical tuft comprising a second bristle wall having an inner surface defining a second cavity along a second cavity axis, the second cavity having a transverse cross-sectional area that increases with distance from the front surface of the head; and the first and second conical tufts arranged on a transverse axis of the head that is perpendicular to the longitudinal axis; the plurality of tooth cleaning elements comprising a third conical tuft comprising a third bristle wall having an inner surface defining a third cavity along a third cavity axis, the third cavity having a transverse cross-sectional area that increases with distance from the front surface of the head; the plurality of tooth cleaning elements comprising a fourth conical tuft comprising a fourth bristle wall having an inner surface defining a fourth cavity along a fourth cavity axis, the fourth cavity having a transverse cross-sectional area that increases with distance from the front surface of the head; and the third and fourth conical tufts located on the longitudinal axis of the head.

In yet another aspect, the invention can be an oral care implement comprising: a handle; a head coupled to the handle, the head comprising a front surface and a longitudinal axis that extends from a proximal end of the head to a distal end of the head; a plurality of tooth cleaning elements extending from the front surface of the head; and the plurality of tooth cleaning elements comprising a first conical tuft comprising a first bristle wall having an inner surface defining a first cavity along a first cavity axis, the first cavity having a transverse cross-sectional area that increases with distance from the front surface of the head, wherein the first bristle wall of the first conical tuft terminates in a first annular top surface that is inclined relative to the front surface from a first high point to a first low point.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
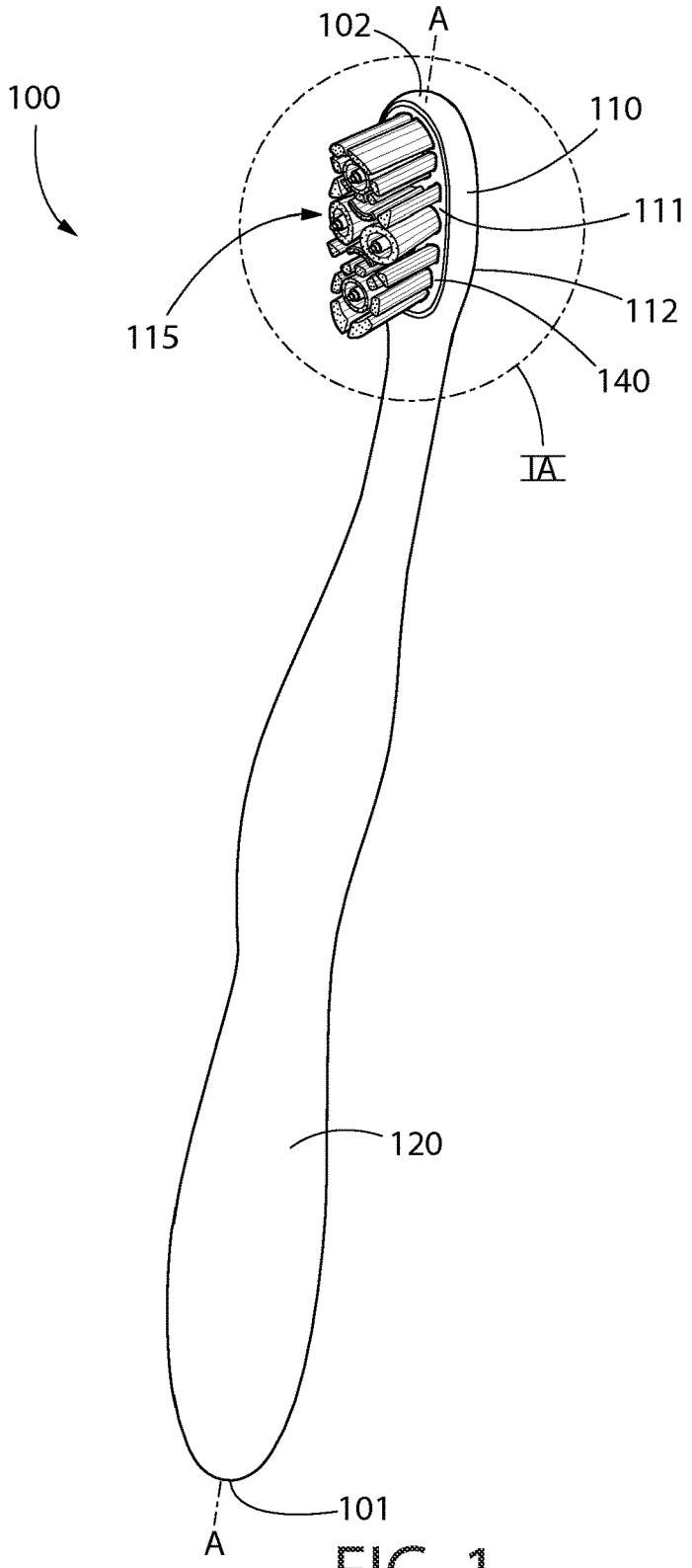
FIG. 1 is a front perspective view of an oral care implement in accordance with one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 1A:
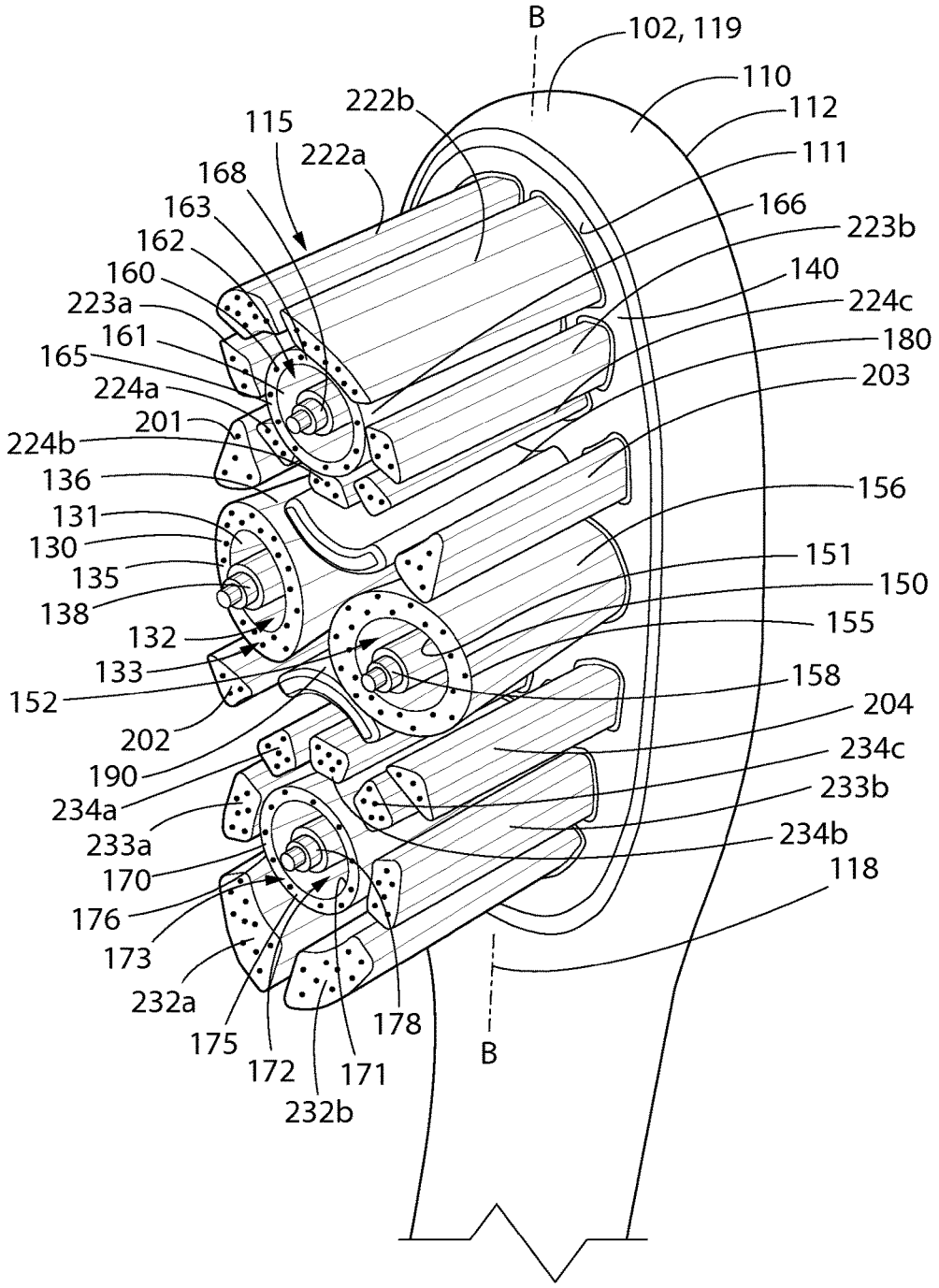
FIG. 1A is a close-up view of area IA of FIG. 1.
Figure 2:
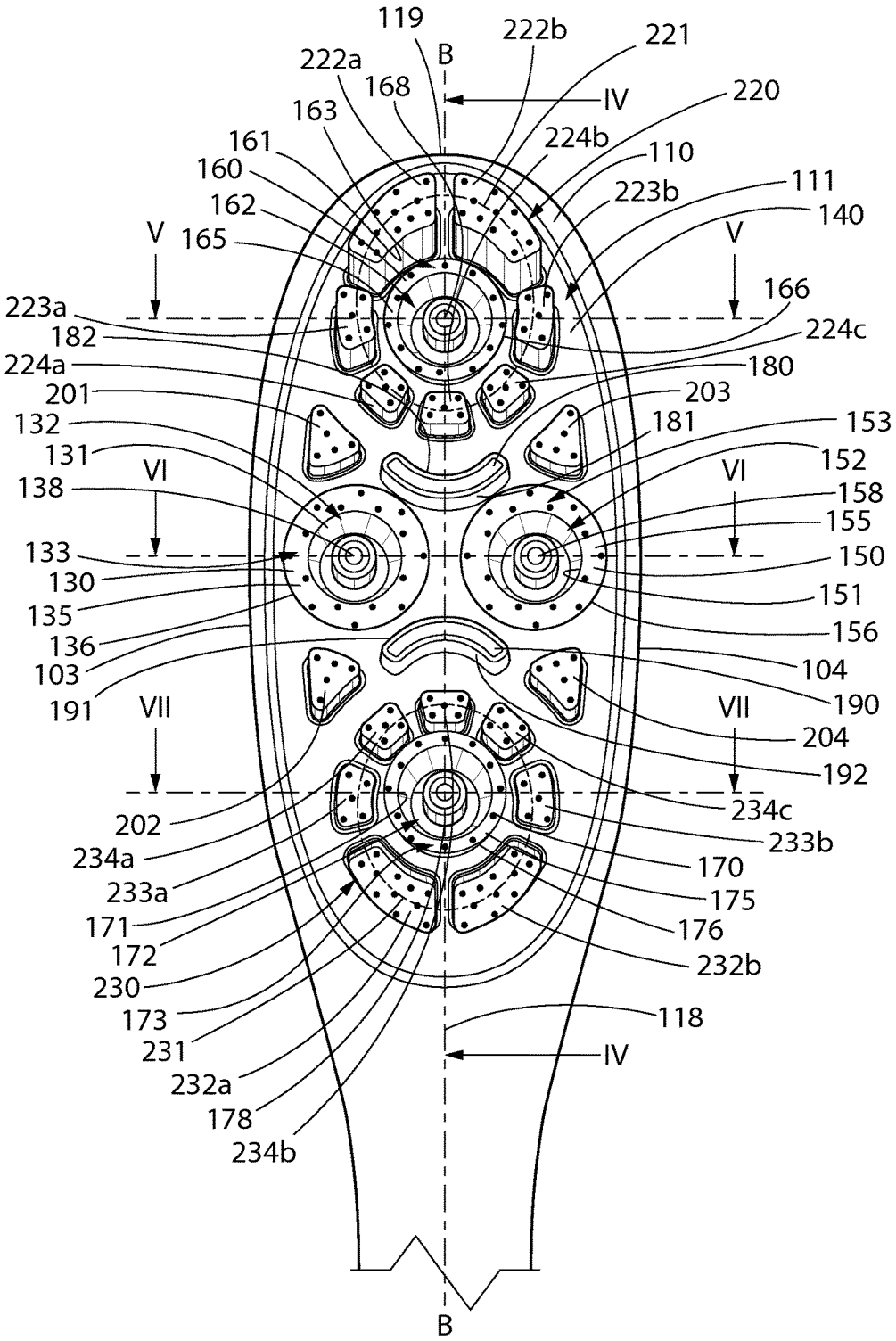
FIG. 2 is a front view of the head of the oral care implement of FIG. 1A.
Figure 3:
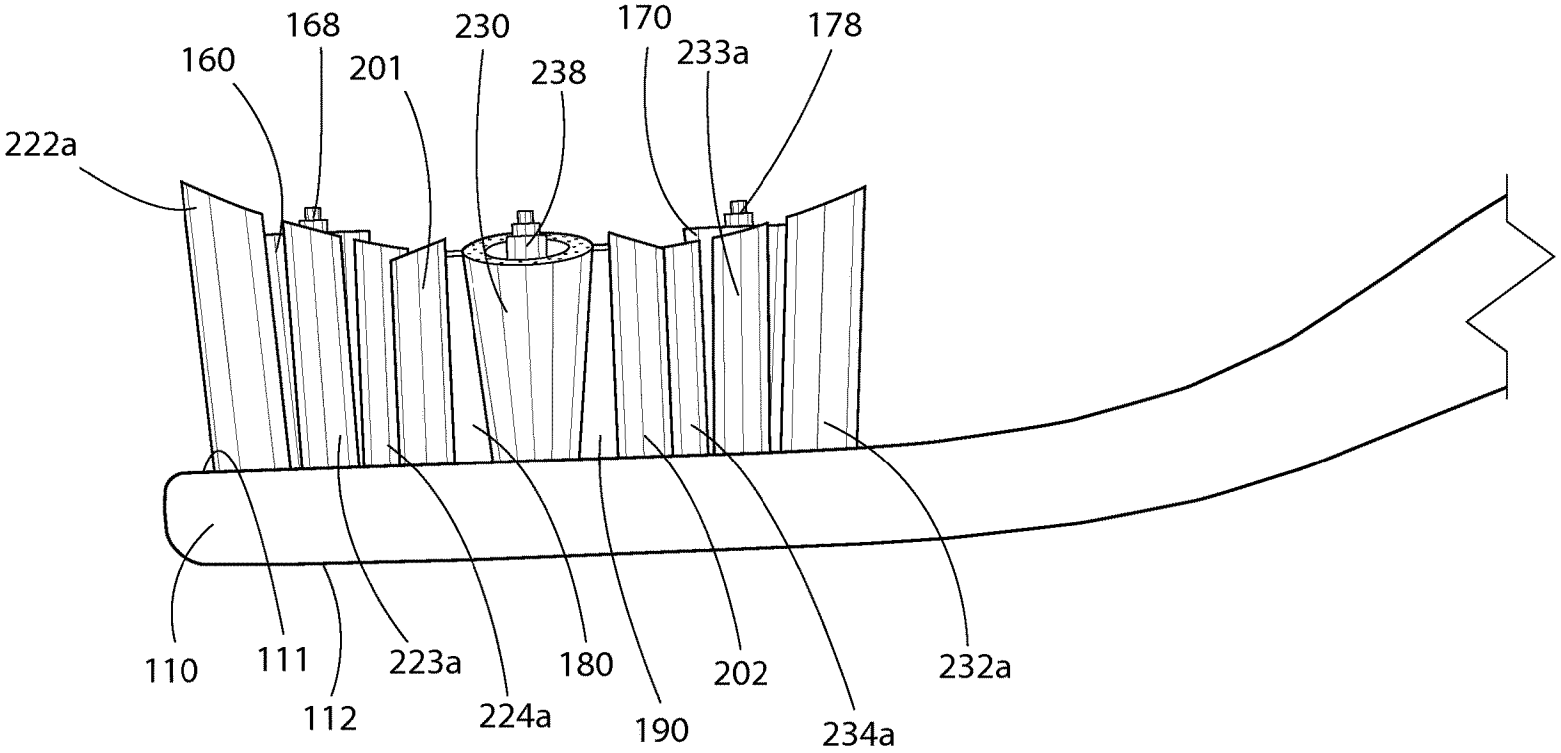
FIG. 3 is a side view of the head of the oral care implement of FIG. 1A.
Figure 4:
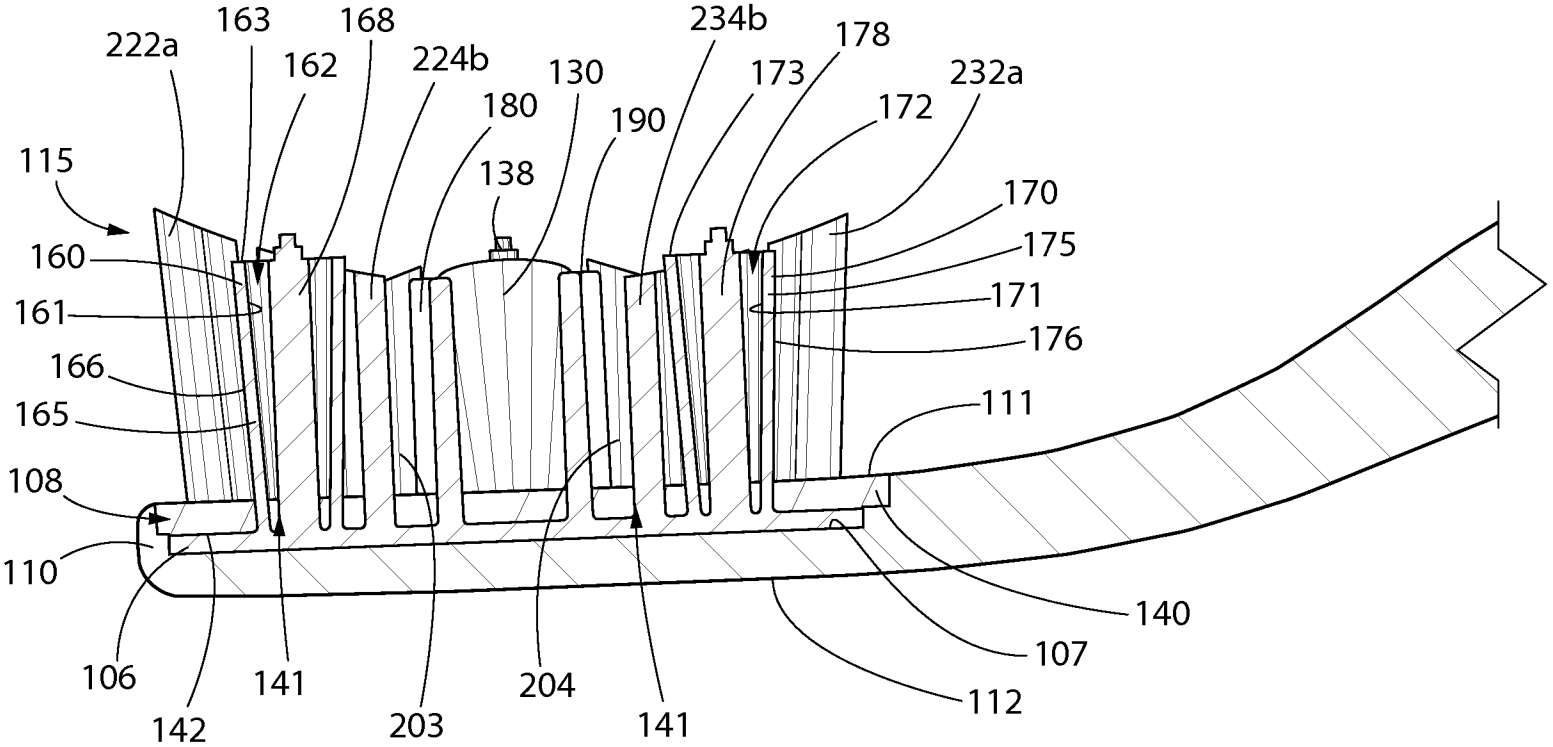
FIG. 4 is a cross-sectional view taken along line IV-IV of FIG. 2.
Figure 5:
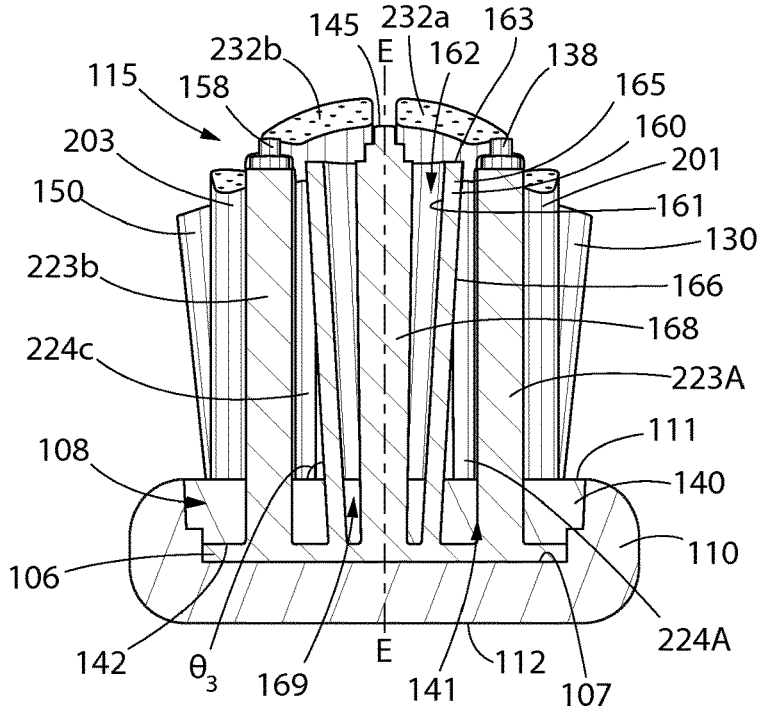
FIG. 5 is a cross-sectional view taken along line V-V of FIG. 2.

Referring first to FIGS. 1, 1A, and 2 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 100 extends from a proximal end 101 to a distal end 102 along a longitudinal axis A-A. The oral care implement 100 generally comprises a head 110 and a handle 120. The head 110 extends from a proximal end 118 to a distal end 119 along a longitudinal axis B-B that is coextensive with the longitudinal axis A-A of the oral care implement 100. Furthermore, in the exemplified embodiment the distal end 102 of the oral care implement 100 is the same as the distal end 119 of the head 110.

The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used including metal, wood, or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 111 and an opposing rear surface 112. In the exemplified embodiment, the head 110 is formed integrally with the handle 120 as a single unitary structure using a molding, milling, machining, or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 110 may, in certain embodiments, be formed of any of the rigid plastic materials described above as being used for forming the handle 120, although the invention is not to be so limited in all embodiments and other materials that are commonly used during toothbrush head manufacture may also be used.

The oral care implement 100 also comprises a plurality of tooth cleaning elements 115 extending from the front surface 111 of the head 110. The details of certain ones of the plurality of tooth cleaning elements 115 will be discussed below, including specific details with regard to structure, pattern, orientation, and material of such tooth cleaning elements 115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning elements 115 in some embodiments. However, as described herein below, in certain embodiments one or more of the tooth cleaning elements 115 may be formed as tufts of bristles.

In embodiments that use elastomeric elements as one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring to FIGS. 1-7 concurrently, one manner in which the tooth cleaning elements 115 are secured to the head 110 will be described. Specifically, in the exemplified embodiment the tooth cleaning elements 115 are formed as a cleaning element assembly on a head plate 140 such that one or more of the tooth cleaning elements 115 are mounted onto the head plate 140 and then the head plate 140 is coupled to the head 110. In such an embodiment, the head plate 140 is a separate and distinct component from the head 110 of the oral care implement 100. However, the head plate 140 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 140 and the head 110 are separately formed components that are secured together during manufacture of the oral care implement 100.

In certain embodiments, the head plate 140 may comprise a plurality of holes 141 formed therethrough, and the tooth cleaning elements 115 may be mounted to the head plate 140 within the holes 141. This type of technique for mounting the tooth cleaning elements 115 to the head 110 via the head plate 140 is generally known as anchor free tufting (AFT). Specifically, in AFT a plate or membrane (i.e., the head plate 140) is created separately from the head 110. The tooth cleaning elements 115 (such as bristles, elastomeric elements, and combinations thereof) are positioned into the head plate 140 so as to extend through the holes 141 of the head plate 140. The free ends of the tooth cleaning elements 115 on one side of the head plate 140 perform the cleaning function. The ends of the tooth cleaning elements 115 on the other side of the head plate 140 are melted together by heat to be anchored in place. As the tooth cleaning elements 105 are melted together, a melt matte 106 is formed, which is a layer of plastic formed from the collective ends of the tooth cleaning elements 115 that prevents the tooth cleaning elements 115 from being pulled through the tuft holes 141.

After the tooth cleaning elements 115 are secured to the head plate 140, the head plate 140 is secured to the head 110 such as by ultrasonic welding. When the head plate 140 is coupled to the head 110, the melt matte 106 is located between a lower surface 142 of the head plate 140 and a floor 107 of a basin 108 of the head 110 in which the head plate 140 is disposed. The melt matte 106, which is coupled directly to and in fact forms a part of the tooth cleaning elements 115, prevents the tooth cleaning elements 115 from being pulled through the holes 141 in the head plate 140 thus ensuring that the tooth cleaning elements 105 remain attached to the head plate 140 during use of the oral care implement 100.

In another embodiment, the tooth cleaning elements may be connected to the head 110 using a technique known in the art as AMR. In this technique, the handle is formed integrally with the head plate as a one-piece structure. After the handle and head plate are formed, the bristles are inserted into holes in the head plate so that free/cleaning ends of the bristles extend from the front surface of the head plate and bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleaner is injection molded onto the rear surface of the head plate, thereby trapping the melt matte between the tissue cleaner and the rear surface of the head plate. In other embodiments, other structures may be coupled to the rear surface of the head plate to trap the melt matte between the rear surface of the head plate and such structure without the structure necessarily being a tissue cleaner (the structure can just be a plastic material that is used to form a smooth rear surface of the head, or the like, and the structure can be molded onto the rear surface of the head plate or snap-fit (or other mechanical coupling) to the rear surface of the head plate as desired).

Of course, techniques other than AFT and AMR can be used for mounting the tooth cleaning elements 115 to the head 110, such as widely known and used stapling techniques or the like. In such embodiments the head plate 140 may be omitted and the tooth cleaning elements 115 may be coupled directly to the head 110. Furthermore, in a modified version of the AFT process discussed above, the head plate 140 may be formed by positioning the tooth cleaning elements 115 within a mold, and then molding the head plate 140 around the tooth cleaning elements 115 via an injection molding process. However, it should be appreciated that certain of the bristle tufts disclosed herein cannot be adequately secured to the head using staple techniques, and one of AFT or AMR is therefore use for securing such bristle tufts (i.e., the conical tufts described below) to the head.

Although described herein above with regard to using AFT, in certain embodiments any suitable form of cleaning elements and attachment may be used in the broad practice of this invention. Specifically, the tooth cleaning elements 115 of the present invention can be connected to the head 110 in any manner known in the art. For example, staples/ anchors or in-mold tufting (IMT) could be used to mount the cleaning elements/tooth engaging elements. In certain embodiments, the invention can be practiced with various combinations of stapled, IMT, AMR, or AFT bristles. Alternatively, the tooth cleaning elements 115 could be mounted to tuft blocks or sections by extending through suitable openings in the tuft blocks so that the base of the tooth cleaning elements 115 is mounted within or below the tuft block.

Although not illustrated herein, in certain embodiments the head 110 may also include a soft tissue cleanser coupled to or positioned on its rear surface 112. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Still referring to FIGS. 1-7, the oral care implement 100, and specifically the tooth cleaning elements 115 of the oral care implement 100, will be further described. In the exemplified embodiment, the plurality of tooth cleaning elements 115 comprise a first conical tuft 130, a second conical tuft 150, a third conical tuft 160, and a fourth conical tuft 170. Each of the first, second, third, and fourth conical tufts 130, 150, 160, 170 is a tuft or grouping of bristles that are arranged together into a tuft and then secured into a single tuft hole within the head 110 (or within the head plate 140). The first, second, third, and fourth conical tufts 130, 150, 160, 170 are described herein as being conical due to the first, second, third, and fourth conical tufts 130, 150, 160, 170 having a conical shape. More specifically, as can best be seen in FIGS. 2 and 4-7, the first, second, third, and fourth conical tufts 130, 150, 160, 170 are in the shape of a truncated cone wherein the portion of the first, second, third, and fourth conical tufts 130, 150, 160, 170 that is positioned within the head 110 is the truncated (i.e., cut off) portion of the cone such that the first, second, third, and fourth conical tufts 130, 150, 160, 170 are in the shape of an inverted truncated cone.

Figure 6:
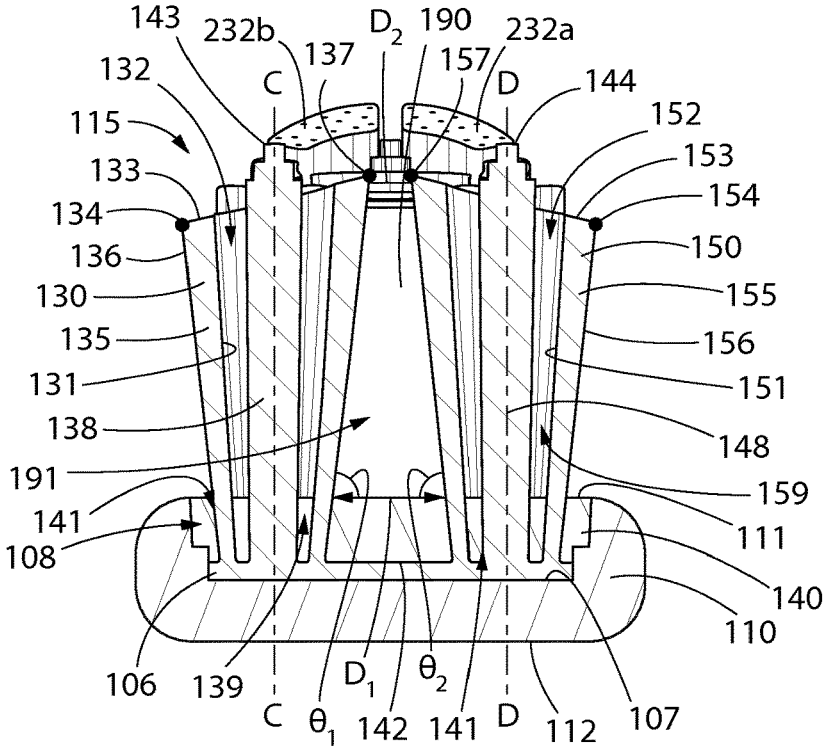
FIG. 6 is a cross-sectional view taken along line VI-VI of FIG. 2.
Figure 7:
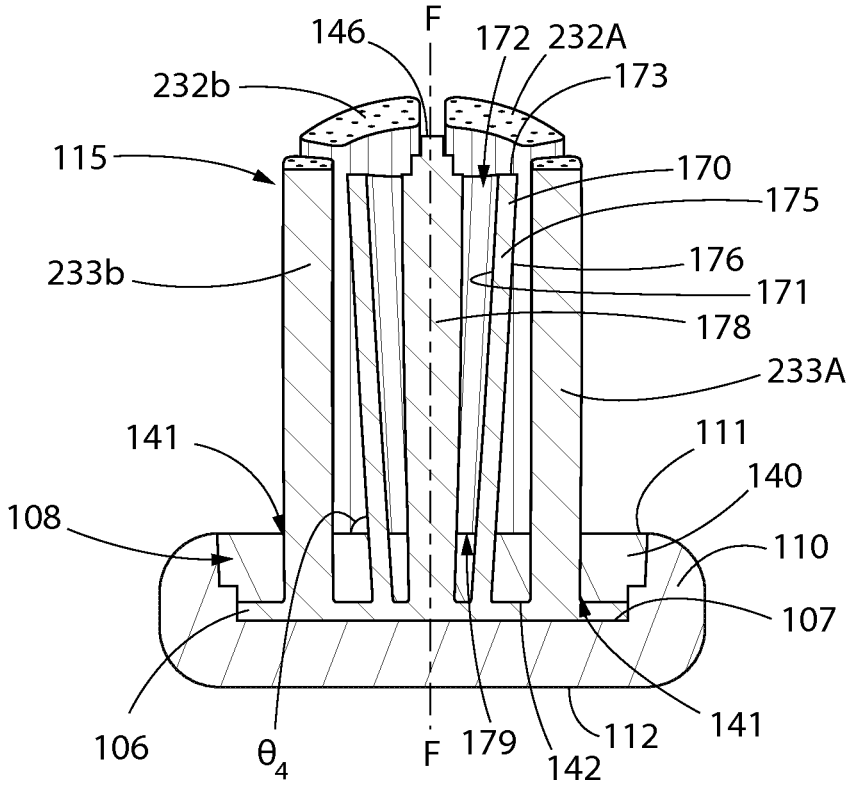
FIG. 7 is a cross-sectional view taken along line VII-VII of FIG. 2.

Referring now to FIGS. 1A, 2, and 6 concurrently, the first and second conical tufts 130, 150 will be further described. The first conical tuft 130 comprises a first continuous bristle wall 135 having an inner surface 131 and an outer surface 136. The inner surface 131 of the first continuous bristle wall 135 of the first conical tuft 130 defines a first cavity 132 that extends along a first cavity axis C-C. In the exemplified embodiment, the first conical tuft 130, and specifically the first continuous bristle wall 135 thereof, extends in a 360° manner about the first cavity axis C-C without any breaks or gaps.

The first cavity 132 of the first conical tuft 130 has an open top end and is bounded by the inner surface 131 of the first continuous bristle wall 135 and by the front surface 111 of the head 110. As noted above, the first conical tuft 130 in the exemplified embodiment is formed by a plurality of bristles. Specifically, the plurality of bristles are clumped together and positioned collectively into a single tuft hole so that the plurality of bristles collectively form the first conical tuft 130 having no gaps in the first continuous bristle wall 135 for its entire 360° extension about the first cavity axis C-C. Thus, the first conical tuft 130 extends from a single tuft hole. The term continuous bristle wall is intended to mean that the first conical tuft 130 is a single tuft of bristles that are clumped together into a single tuft hole in a non-spaced apart manner.

Thus, the first conical tuft 130 is a single tuft formed from a plurality of individual bristles that are positioned together within a single tuft hole. As a result, in the exemplified embodiment the first conical tuft 130 has the first continuous bristle wall 135 that extends without discontinuity about the first cavity axis C-C. Thus, in the exemplified embodiment there are no gaps formed into the outer surface 136 of the first conical tuft 130. Of course, in other embodiments the first conical tuft 130 may have small gaps therein as desired while still being a single tuft positioned within a single tuft hole. Such gaps in the bristle wall may prevent dentifrice from being trapped within the first cavity 132 of the first conical tuft 130 by providing means of egress from the first cavity 132. In such an embodiment, the first bristle wall 135 may not be continuous. In one embodiment, the first conical tuft 130 is secured to the head 110 by anchor free tufting or AMR.

Due to the conical shape of the first conical tuft 130, and more specifically, the inverted conical shape of the first conical tuft 130, the first cavity 132 of the first conical tuft 130 has a first transverse cross-sectional area that increases with distance from the front surface 111 of the head 110. Specifically, the first transverse cross-sectional area of the first cavity 132 of the first conical tuft 130 only increases and never decreases with distance from the front surface 111 of the head 110. Thus, the greater the distance between a particular axial location within the first cavity 132 of the first conical tuft 130 and the front surface 111 of the head 110, the greater the transverse cross-sectional area of the first cavity 132 at that particular axial location. Stated another way, the diameter of the first cavity 132 increases with distance from the front surface 111 of the head 110 so that the diameter of the first cavity 132 is greater at the terminal ends of the bristles of the first conical tuft 130 than at the front surface 111 of the head 110.

The first continuous bristle wall 135 of the first conical tuft 130 terminates in a first annular top surface 133. In the exemplified embodiment, the first annular top surface 133 is inclined relative to the front surface 111 of the head 110 such that the height of the first conical tuft 130 increases with distance from the peripheral edge of the head 110 towards the center of the head 110. Thus, the first annular top surface 133 has a first low point 134 and a first high point 137. The first annular top surface 133 is inclined relative to the front surface 111 of the head 110 from the first low point 134 to the first high point 137. Specifically, the first annular top surface 133 may be inclined at approximately between 10° and 20° relative to the front surface 111 of the head 110, and more specifically between 10° and 15° relative to the front surface 111 of the head 110. In other embodiments the angle may be greater than 20°, such as between 20° and 30° or the like.

The second conical tuft 150 comprises a second continuous bristle wall 155 having an inner surface 151 and an outer surface 156. The inner surface 151 of the second continuous bristle wall 155 of the second conical tuft 150 defines a second cavity 152 that extends along a second cavity axis D-D. The second conical tuft 150, and specifically the second continuous bristle wall 155 thereof, extends in a 360° manner about the second cavity axis D-D. The second cavity 152 of the second conical tuft 150 has an open top end and is bounded by the inner surface 151 of the second continuous bristle wall 155 and by the front surface 111 of the head 110.

The second conical tuft 150 in the exemplified embodiment is formed by a plurality of bristles. Specifically, the plurality of bristles are clumped together and positioned collectively into a single tuft hole so that the plurality of bristles collectively form the second conical tuft 150 having no gaps in the second continuous bristle wall 155 for its entire 360° extension about the second cavity axis D-D. Thus, the second conical tuft 150 extends from a single tuft hole. The term continuous bristle wall is intended to mean that the second conical tuft 150 is a single tuft of bristles that are clumped together into a single tuft hole in a non-spaced apart manner. Of course, in other embodiments the second bristle wall 155 may not be continuous as it may have gaps or the like formed therein.

Thus, the second conical tuft 150 is a single tuft formed from a plurality of individual bristles that are positioned together within a single tuft hole. As a result, in the exemplified embodiment the second conical tuft 150 has the second continuous bristle wall 155 that extends without discontinuity about the second cavity axis D-D. Thus, in the exemplified embodiment there are no gaps formed into the outer surface 156 of the second conical tuft 150. Of course, in other embodiments the second conical tuft 150 may have small gaps therein as desired while still being a single tuft positioned within a single tuft hole. Such gaps in the bristle wall may prevent dentifrice from being trapped within the second cavity 152 of the second conical tuft 150 by providing means of egress from the second cavity 152. In one embodiment, the second conical tuft 150 is secured to the head 110 by anchor free tufting or AMR.

Due to the conical shape of the second conical tuft 150, and more specifically, the inverted conical shape of the second conical tuft 150, the second cavity 152 of the second conical tuft 150 has a second transverse cross-sectional area that increases with distance from the front surface 111 of the head 110. Specifically, the second transverse cross-sectional area of the second cavity 152 of the second conical tuft 150 only increases and never decreases with distance from the front surface 111 of the head 110. Thus, the greater the distance between a particular axial location within the second cavity 152 of the second conical tuft 150 and the front surface 111 of the head 110, the greater the transverse cross-sectional area of the second cavity 152 at that particular axial location. Stated another way, the diameter of the second cavity 152 increases with distance from the front surface 111 of the head 110 so that the diameter of the second cavity 152 is greater at the terminal ends of the bristles of the second conical tuft 150 than at the front surface 111 of the head 110.

The second continuous bristle wall 155 of the second conical tuft 150 terminates in a second annular top surface 153. In the exemplified embodiment, the second annular top surface 153 is inclined relative to the front surface 111 of the head 110 such that the height of the second conical tuft 150 increases with distance from the peripheral edge of the head 110 towards the center of the head 110. Thus, the second annular top surface 153 has a second low point 154 and a second high point 157. The second annular top surface 153 is inclined relative to the front surface 111 of the head 110 from the second low point 154 to the second high point 157. Specifically, the second annular top surface 153 may be inclined at approximately between 10° and 20° relative to the front surface 111 of the head 110, and more specifically between 10° and 15° relative to the front surface 111 of the head 110. In other embodiments the angle may be greater than 20°, such as between 20° and 30° or the like.

The first and second conical tufts 130, 150 are positioned on the head 110 in an adjacent manner. More specifically, the first and second conical tufts 130, 150 are positioned adjacent to one another on opposite sides of the longitudinal axis B-B of the head 110. Furthermore, in the exemplified embodiment each of the first and second conical tufts 130, 150 is positioned on a transverse axis Z-Z (see FIG. 2) that is perpendicular to the longitudinal axis B-B of the head 110 and that is centrally located on the head 110 so as to divide the head 110 into two halves of substantially equal length. Moreover, the first and second conical tufts 130, 150 are positioned such that a transverse reference plane that is substantially perpendicular to the longitudinal axis B-B of the head 110 and perpendicular to the front surface 111 of the head 110 intersects the first and second high points 137, 157 and the first and second low points 134, 154 (the transverse reference plane would be a plane that includes the transverse axis Z-Z and extends perpendicular to the front surface 111 of the head 110). Of course, the invention is not to be so limited and the transverse axis Z-Z need not be located centrally on the head 110 in all embodiments, but rather the transverse axis Z-Z can be any axis that is perpendicular to the longitudinal axis B-B of the head 110 and that extends along the width of the head 110.

Furthermore, in the exemplified embodiment the first low point 134 of the first conical tuft 130 is positioned adjacent to a first lateral edge 103 of the head 110 and the first high point 137 of the first conical tuft 130 is positioned in a central region of the head 110. The second low point 154 of the second conical tuft 150 is positioned adjacent to a second lateral edge 104 of the head 110 and the second high point 157 of the second conical tuft 150 is positioned in a central region of the head 110. Thus, the first high point 137 of the first conical tuft 130 is positioned adjacent to the first high point 157 of the second conical tuft 150. As used in regard to the locations of the first and second high points 137, 157 of the first and second conical tufts 130, 150, the term adjacent means that there are no intervening tufts between the first high point 137 of the first conical tuft 130 and the second high point 157 of the second conical tuft 150. Thus, although the first and second conical tufts 130, 150 are spaced apart from one another, the first high point 137 of the first conical tuft 130 is immediately adjacent to the second high point 157 of the second conical tuft 150 with no tufts or other cleaning elements positioned between the first high point 137 of the first conical tuft 130 and the second high point 157 of the second conical tuft 150 in a direction of the transverse axis Z-Z.

Furthermore, due to the conical shape of the first and second conical tufts 130, 150, the distance between the first and second conical tufts 130, 150 decreases with increasing distance from the front surface 111 of the head 110. Thus, the first and second conical tufts 130, 150 are spaced apart by a first distance D1 at the front surface 111 of the head 110. The first and second conical tufts 130, 150 are spaced apart by a second distance D2 at the first and second high points 137, 157 of the first and second conical tufts 130, 150. The first distance D1 is greater than the second distance D2.

The first annular top surface 133 of the first conical tuft 130 slopes downwardly with distance from the longitudinal axis B-B towards the first lateral edge 103 of the head 110. The second annular top surface 153 of the second conical tuft 150 slopes downwardly with distance from the longitudinal axis B-B towards the second lateral edge 104 of the head 110. Thus, each of the first and second annular top surfaces 133, 153 of the first and second conical tufts 130, 150 slopes downwardly with increasing distance from a longitudinal reference plane that is parallel to (or includes) the longitudinal axis B-B and is perpendicular to the front surface 111 of the head 110.

As can be seen from FIG. 6, in the exemplified embodiment each of the first and second annular top surfaces 133, 153 of the first and second conical tufts 130, 150 has a linear side profile when viewed from the transverse reference plane noted above. Of course, the invention is not to be so limited in all embodiments and in certain other embodiments one or both of the first and second annular top surfaces 133, 153 of the first and second conical tufts 130, 150 may have a concave or convex side profile when viewed from the transverse reference plane.

In the exemplified embodiment, the outer surface 136 of the first conical tuft 130 forms a first angle θ1 with the front surface 111 of the head 110. Furthermore, the outer surface 156 of the second conical tuft 150 forms a second angle θ2 with the front surface 111 of the head 110. In certain embodiments, the first and second angles θ1, θ2 may be the same, although in other embodiments the first and second angles θ1, θ2 may be different. In certain embodiments, each of the first and second acute angles θ1, θ2 are between 80° and 89°, more specifically between 83.5° and 87.5°. In certain embodiments, one or both of the first and second acute angles θ1, θ2 is between 82° and 85°, and in other embodiments one or both of the first and second acute angles θ1, θ2 is between 86° and 89°. Furthermore, one of the first and second acute angles θ1, θ2 may be between 82° and 85° while the other one of the first and second acute angles θ1, θ2 is between 86° and 89°.

Still referring to FIGS. 1A, 2, and 6 concurrently, in the exemplified embodiment a first central cleaning element 138 is located within the first central cavity 132 of the first conical tuft 130. In some embodiments, the first central cleaning element 138 and the first conical tuft 130 may be positioned within a single tuft hole. However, the invention is not to be so limited in all embodiments and in certain other embodiments the first central cleaning element 138 may be positioned in a tuft hole that is spaced apart from and surrounded by the tuft hole within which the first conical tuft 130 is positioned. The first central cleaning element 138 (and any other central cleaning element discussed herein below) may be a tapered bristle tuft, a bristle tuft that comprises tapered bristles, a non-tapered bristle tuft, a rounded bristle tuft, bristle tuft that comprises spiral bristle, combinations thereof, or the like.

In the exemplified embodiment, the first central cleaning element 138 extends perpendicularly from the front surface 111 of the head 110. In the exemplified embodiment, an annular gap 139 is present between an outer surface of the first central cleaning element 138 and the inner surface 131 of the first conical tuft 130. In the exemplified embodiment, the annular gap 139 extends to below the front surface 111 of the head 110. Furthermore, in the exemplified embodiment the first central cleaning element 139 converges with the first conical tuft 130 at the melt matte 106. Due to the conical shape of the first conical tuft 130 and the perpendicular extension of the first central cleaning element 138 relative to the front surface 111 of the head 110, the distance between the outer surface of the first central cleaning element 138 and the inner surface 131 of the first conical tuft 130 increases with distance from the front surface 111 of the head 110.

Figure 8:
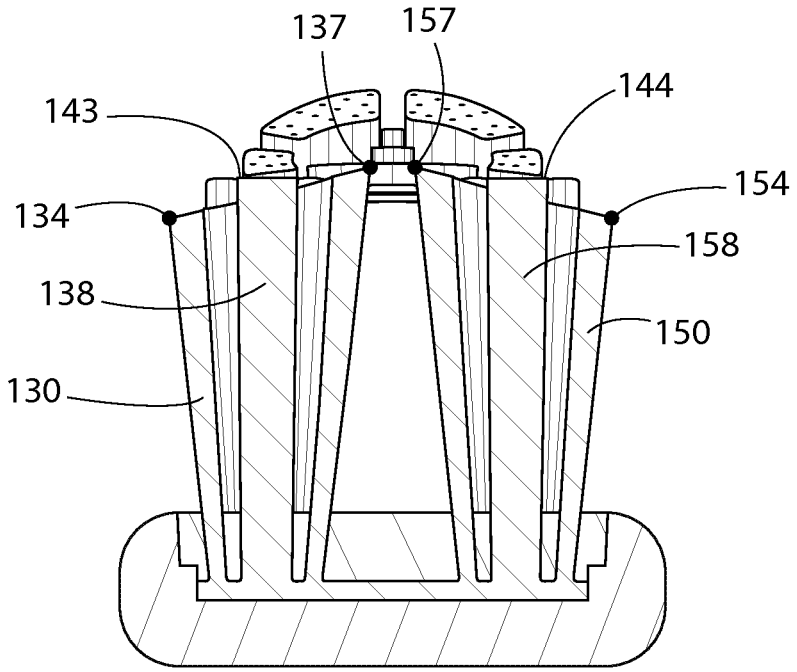
FIG. 8 is an alternative cross-section taken along line VI-VI of FIG. 2.

The first central cleaning element 138 terminates in a free end 143. In the embodiment exemplified in FIGS. 1A, 2, and 6, the free end 143 of the first central cleaning element 138 extends to a height that is above the first low point 134 of the first conical tuft 130 and above the first high point 137 of the first conical tuft 130. However, referring briefly to FIG. 8, in another embodiment the free end 143 of the first central cleaning element 138 may extend to a height that is above the first low point 134 of the first conical tuft 130 and below the first high point 137 of the first conical tuft 130. Furthermore, in still other embodiments the free end 143 of the first central cleaning element 138 may extend to a height that is below the first low point 134 of the first conical tuft 130.

Furthermore, in the exemplified embodiment a second central cleaning element 158 is located within the second central cavity 152 of the second conical tuft 150. The second central cleaning element 158 may share a single tuft hole with the second conical tuft 150 or each may have its own separate tuft hole as discussed above with regard to the first central cleaning element 138. In the exemplified embodiment, the second central cleaning element 158 extends perpendicularly from the front surface 111 of the head 110. In the exemplified embodiment, an annular gap 159 is present between an outer surface of the second central cleaning element 158 and the inner surface 151 of the second conical tuft 150. In the exemplified embodiment, the annular gap 159 extends to below the front surface 111 of the head 110. Furthermore, in the exemplified embodiment the second central cleaning element 158 converges with the second conical tuft 150 at the melt matte 106. Due to the conical shape of the second conical tuft 150 and the perpendicular extension of the second central cleaning element 158 relative to the front surface 111 of the head 110, the distance between the outer surface of the second central cleaning element 158 and the inner surface 141 of the second conical tuft 135 increases with distance from the front surface 111 of the head 110.

The second central cleaning element 158 terminates in a free end 144. In the embodiment exemplified in FIGS. 1A, 2, and 6, the free end 144 of the second central cleaning element 158 extends to a height that is above the second low point 154 of the second conical tuft 150 and above the second high point 157 of the second conical tuft 150. However, referring briefly to FIG. 8, in another embodiment the free end 144 of the second central cleaning element 158 may extend to a height that is above the second low point 154 of the second conical tuft 150 and below the second high point 157 of the second conical tuft 150. Furthermore, in still other embodiments the free end 144 of the second central cleaning element 158 may extend to a height that is below the second low point 154 of the second conical tuft 150.

The plurality of tooth cleaning elements 115 also include a first arcuate tooth cleaning element 180 having a first convex side surface 181 and a first concave side surface 182 and a second arcuate tooth cleaning element 190 having a second convex side surface 191 and a second concave side surface 192. In the exemplified embodiment, each of the first and second arcuate tooth cleaning elements 180, 190 are formed of an elastomeric material (i.e., elastomer, thermoplastic elastomer, etc.). However, the invention is not to be so limited in all embodiments and in certain other embodiments the first and second arcuate tooth cleaning elements 180, 190 may be formed as tufts of bristles.

The first and second arcuate tooth cleaning elements 180, 190 are positioned on the head so that the first and second conical tufts 130, 150 are in between the first and second arcuate tooth cleaning elements 180, 190. Furthermore, the first and second arcuate tooth cleaning elements 180, 190 are oriented so that the convex side surfaces 181, 191 of the first and second arcuate tooth cleaning elements 180, 190 are facing the first and second conical tufts 130, 150. More specifically, the convex side surface 181 of the first arcuate tooth cleaning element 180 faces the first and second conical tufts 130, 150 and the concave side surface 182 of the first arcuate tooth cleaning element 180 faces the distal end 119 of the head 110. The convex side surface 191 of the second arcuate tooth cleaning element 190 faces the first and second conical tufts 130, 150 and the concave side surface 192 of the second arcuate tooth cleaning element 190 faces the proximal end 118 of the head 110. Thus, the first and second arcuate tooth cleaning elements 180, 190 are located on opposite sides of the first and second conical tufts 130, 150 and on opposite sides of the transverse axis Z-Z. Furthermore, the first and second arcuate tooth cleaning elements 180, 190 are located on the longitudinal axis B-B of the head 110.

The plurality of tooth cleaning elements 115 also includes a first peripheral tooth cleaning element 201 and a second peripheral tooth cleaning element 202 located along the first lateral edge 103 of the head 110. Furthermore, the plurality of tooth cleaning elements 115 includes a third peripheral cleaning element 203 and a fourth peripheral cleaning element 204 located along the second lateral edge 104 of the head 110. In the exemplified embodiment, each of the first, second, third, and fourth peripheral tooth cleaning elements 201, 202, 203, 204 are tufts of bristles, although they could be formed of elastomer in other embodiments. Furthermore, in the exemplified embodiment the first conical tuft 130 is located between the first and second peripheral tooth cleaning elements 201, 202 and the second conical tuft 150 is located between the third and fourth peripheral tooth cleaning elements 203, 204. In the exemplified embodiment, each of the first, second, third, and fourth peripheral tooth cleaning elements 201, 202, 203, 204 has a triangular-shaped cross-section. However, the invention is not to be so limited in all embodiments and other cross-sectional shapes can be used for the first, second, third, and fourth peripheral tooth cleaning elements 201, 202, 203, 204.

In the exemplified embodiment, each of the first, second, third, and fourth peripheral tooth cleaning elements 201, 202, 203, 204 has three edges and three corners. One of the edges of the first peripheral tooth cleaning element 201 faces the first conical tuft 130, one of the edges of the first peripheral tuft 201 faces the third conical tuft 160, and one of the edges of the first peripheral tuft 201 faces the first lateral side edge 103 of the head 110. One of the edges of the second peripheral tooth cleaning element 202 faces the first conical tuft 130, one of the edges of the second peripheral tooth cleaning element 202 faces the fourth conical tuft 170, and one of the edges of the second peripheral tooth cleaning element 202 faces the first lateral side edge 103 of the head 110. One of the edges of the third peripheral tooth cleaning element 203 faces the second conical tuft 140, one of the edges of the third peripheral tooth cleaning element 203 faces the third conical tuft 160, and one of the edges of the third peripheral tooth cleaning element 203 faces the second lateral side edge 104 of the head 110. Finally, one of the edges of the fourth peripheral tooth cleaning element 204 faces the second conical tuft 150, one of the edges of the fourth peripheral tooth cleaning element 204 faces the fourth conical tuft 170, and one of the edges of the fourth peripheral tooth cleaning element 204 faces the second lateral side edge 104 of the head 110.

Referring to FIGS. 1A, 2, 4 and 5 concurrently, the third conical tuft 160 will be further described. The third conical tuft 160 comprises a third continuous bristle wall 165 having an inner surface 161 and an outer surface 166. The inner surface 161 of the third continuous bristle wall 165 of the third conical tuft 160 defines a third cavity 162 that extends along a third cavity axis E-E. In the exemplified embodiment, the third conical tuft 160, and specifically the third continuous bristle wall 165 thereof, extends in a 360° manner about the third cavity axis E-E. Of course, the invention is not to be so limited in all embodiments and the third bristle wall 165 may not be continuous in other embodiments. The third cavity 162 of the third conical tuft 160 has an open top end and is bounded by the inner surface 161 of the third continuous bristle wall 165 and by the front surface 111 of the head 110. As noted above, the third conical tuft 160 in the exemplified embodiment is formed by a plurality of bristles. Specifically, the plurality of bristles are clumped together and positioned collectively into a single tuft hole so that the plurality of bristles collectively form the third conical tuft 160 having no gaps in the third continuous bristle wall 165 for its entire 360° extension about the third cavity axis E-E. Thus, the third conical tuft 160 extends from a single tuft hole. The term continuous bristle wall is intended to mean that the third conical tuft 160 is a single tuft of bristles that are clumped together into a single tuft hole in a non-spaced apart manner.

Thus, the third conical tuft 160 is a single tuft formed from a plurality of individual bristles that are positioned together within a single tuft hole. As a result, the third conical tuft 160 has the third continuous bristle wall 165 that extends without discontinuity about the third cavity axis E-E. Thus, in the exemplified embodiment there are no gaps formed into the outer surface 166 of the third conical tuft 160. Of course, in other embodiments the third conical tuft 160 may have small gaps therein as desired while still being a single tuft positioned within a single tuft hole. Such gaps in the bristle wall may prevent dentifrice from being trapped within the third cavity 162 of the third conical tuft 160 by providing means of egress from the third cavity 162. Thus, in certain embodiments the third bristle wall 165 may not be continuous. In one embodiment, the third conical tuft 160 is secured to the head 110 by anchor free tufting or AMR.

Due to the conical shape of the third conical tuft 160, and more specifically, the inverted conical shape of the third conical tuft 160, the third cavity 162 of the third conical tuft 160 has a third transverse cross-sectional area that increases with distance from the front surface 111 of the head 110. Specifically, the third transverse cross-sectional area of the third cavity 162 of the third conical tuft 160 only increases and never decreases with distance from the front surface 111 of the head 110. Thus, the greater the distance between a particular axial location within the third cavity 162 of the third conical tuft 160 and the front surface 111 of the head 110, the greater the transverse cross-sectional area of the third cavity 162 at that particular axial location. Stated another way, the diameter of the third cavity 162 increases with distance from the front surface 111 of the head 110 so that the diameter of the third cavity 162 is greater at the terminal ends of the bristles of the third conical tuft 160 than at the front surface 111 of the head 110.

The third continuous bristle wall 165 of the third conical tuft 160 terminates in a third annular top surface 153. In the exemplified embodiment, the third annular top surface 163 is flat and parallel to the front surface 111 of the head 110. Thus, in the exemplified embodiment the third conical tuft 160 has a constant height. However, in other embodiments the third annular top surface 163 may be inclined relative to the front surface 111 of the head 110 in the same manner as discussed above with regard to the first and second conical tufts 130, 150. Furthermore, in the exemplified embodiment the outer surface 166 of the third conical tuft 160 is oriented at an angle θ3 relative to the front surface 111 of the head 110. The angle θ3 can be any of the angles described above with regard to the first and second angles θ1, θ2. All other description above with regard to the first and second conical tufts 130, 150 that is not contradictory to the description above regarding the third conical tuft 160 may be applicable to the third conical tuft 160 in some embodiments.

In the exemplified embodiment, a third central cleaning element 168 is located within the third central cavity 162 of the third conical tuft 160. In the exemplified embodiment, the third central cleaning element 168 extends perpendicularly from the front surface 111 of the head 110. In the exemplified embodiment, an annular gap 169 is present between an outer surface of the third central cleaning element 168 and the inner surface 161 of the third conical tuft 160. In the exemplified embodiment, the annular gap 169 extends to below the front surface 111 of the head 110. Furthermore, in the exemplified embodiment the third central cleaning element 168 converges with the third conical tuft 160 at the melt matte 106. Due to the conical shape of the third conical tuft 160, the distance between the outer surface of the third central cleaning element 168 and the inner surface 161 of the third conical tuft 160 increases with distance from the front surface 111 of the head 110. The third central cleaning element 168 terminates in a free end 145. In the exemplified embodiment, the free end 145 of the third central cleaning element 168 extends to a height that is above the third annular top surface 163 of the third conical tuft 160. However, the invention is not to be so limited in all embodiments and in some embodiments the free end 145 of the third central cleaning element 168 may extend to a height that is below the third annular top surface 163 of the third conical tuft 160.

Referring to FIGS. 1A, 2, 4 and 7 concurrently, the fourth conical tuft 170 will be further described. The fourth conical tuft 170 comprises a fourth continuous bristle wall 175 having an inner surface 171 and an outer surface 176. The inner surface 171 of the fourth continuous bristle wall 175 of the fourth conical tuft 170 defines a fourth cavity 172 that extends along a fourth cavity axis F-F. In the exemplified embodiment, the fourth conical tuft 170, and specifically the fourth continuous bristle wall 175 thereof, extends in a 360° manner about the fourth cavity axis F-F. The fourth cavity 172 of the fourth conical tuft 170 has an open top end and is bounded by the inner surface 171 of the fourth continuous bristle wall 175 and by the front surface 111 of the head 110. As noted above, the fourth conical tuft 170 in the exemplified embodiment is formed by a plurality of bristles. Specifically, the plurality of bristles are clumped together and positioned collectively into a single tuft hole so that the plurality of bristles collectively form the third conical tuft 170 having no gaps in the third continuous bristle wall 175 for its entire 360° extension about the fourth cavity axis F-F. Thus, the fourth conical tuft 170 extends from a single tuft hole. The term continuous bristle wall is intended to mean that the fourth conical tuft 170 is a single tuft of bristles that are clumped together into a single tuft hole in a non-spaced apart manner.

Thus, the fourth conical tuft 170 is a single tuft formed from a plurality of individual bristles that are positioned together within a single tuft hole. As a result, the fourth conical tuft 170 has the fourth continuous bristle wall 175 that extends without discontinuity about the fourth cavity axis F-F. Thus, in the exemplified embodiment there are no gaps formed into the outer surface 176 of the fourth conical tuft 170. Of course, in other embodiments the fourth conical tuft 170 may have small gaps therein as desired while still being a single tuft positioned within a single tuft hole. In such embodiments, the fourth bristle wall 175 may not be continuous. Such gaps in the bristle wall may prevent dentifrice from being trapped within the fourth cavity 172 of the fourth conical tuft 170 by providing means of egress from the fourth cavity 172. In one embodiment, the fourth conical tuft 170 is secured to the head 110 by anchor free tufting or AMR.

Due to the conical shape of the fourth conical tuft 170, and more specifically, the inverted conical shape of the fourth conical tuft 170, the fourth cavity 172 of the fourth conical tuft 170 has a fourth transverse cross-sectional area that increases with distance from the front surface 111 of the head 110. Specifically, the fourth transverse cross-sectional area of the fourth cavity 172 of the fourth conical tuft 170 only increases and never decreases with distance from the front surface 111 of the head 110. Thus, the greater the distance between a particular axial location within the fourth cavity 172 of the fourth conical tuft 170 and the front surface 111 of the head 110, the greater the transverse cross-sectional area of the fourth cavity 172 at that particular axial location. Stated another way, the diameter of the fourth cavity 172 increases with distance from the front surface 111 of the head 110 so that the diameter of the fourth cavity 172 is greater at the terminal ends of the bristles of the fourth conical tuft 170 than at the front surface 111 of the head 110.

The fourth continuous bristle wall 175 of the fourth conical tuft 170 terminates in a fourth annular top surface 173. In the exemplified embodiment, the fourth annular top surface 173 is flat and parallel to the front surface 111 of the head 110. Thus, in the exemplified embodiment the fourth conical tuft 170 has a constant height. However, in other embodiments the fourth annular top surface 173 may be inclined relative to the front surface 111 of the head 110 in the same manner as discussed above with regard to the first and second conical tufts 130, 150. Furthermore, the outer surface 176 of the fourth conical tuft 170 is oriented at an angle θ4 relative to the front surface 111 of the head 110. The angle θ4 can be any of the angles described above with regard to the first and second angles θ1, θ2. All other description above with regard to the first and second conical tufts 130, 150 that is not contradictory to the description above regarding the fourth conical tuft 170 may be applicable to the fourth conical tuft 170 in some embodiments.

In the exemplified embodiment, a fourth central cleaning element 178 is located within the fourth central cavity 172 of the fourth conical tuft 170. In the exemplified embodiment, the fourth central cleaning element 178 extends perpendicularly from the front surface 111 of the head 110. In the exemplified embodiment, an annular gap 179 is present between an outer surface of the fourth central cleaning element 178 and the inner surface 171 of the fourth conical tuft 170. In the exemplified embodiment, the annular gap 179 extends to below the front surface 111 of the head 110. Furthermore, in the exemplified embodiment the fourth central cleaning element 179 converges with the fourth conical tuft 170 at the melt matte 106. Due to the conical shape of the fourth conical tuft 170, the distance between the outer surface of the fourth central cleaning element 178 and the inner surface 171 of the fourth conical tuft 170 increases with distance from the front surface 111 of the head 110. The fourth central cleaning element 178 terminates in a free end 146. In the exemplified embodiment, the free end 146 of the fourth central cleaning element 178 extends to a height that is above the fourth annular top surface 173 of the fourth conical tuft 170. However, the invention is not to be so limited in all embodiments and in some embodiments the free end 146 of the fourth central cleaning element 178 may extend to a height that is below the fourth annular top surface 173 of the fourth conical tuft 170.

In the exemplified embodiment, each of the third and fourth conical tufts 160, 170 is located on the longitudinal axis B-B of the head 110. More specifically, the third and fourth conical tufts 160, 170 are transversely aligned on the longitudinal axis B-B of the head 110. Furthermore, in the exemplified embodiment the third conical tuft 160 is located between the first and second conical tufts 130, 150 and the distal end 119 of the head and the fourth conical tuft 170 is located between the first and second conical tufts 130, 150 and the proximal end 118 of the head 110. Furthermore, the first arcuate tooth cleaning element 180 is positioned between the first and second conical tufts 130, 150 and the third conical tuft 160 such that the concave side surface 182 of the first arcuate tooth cleaning element 180 faces the third conical tuft 160 and the convex side surface 181 of the first arcuate tooth cleaning element 180 faces the first and second conical tufts 130, 150. Similarly, the second arcuate tooth cleaning element 190 is positioned between the first and second conical tufts 130, 150 and the fourth conical tuft 170 such that the concave side surface 192 of the second arcuate tooth cleaning element 190 faces the fourth conical tuft 170 and the convex side surface 191 of the second arcuate tooth cleaning element 190 faces the first and second conical tufts 130, 150. Furthermore, the first and second conical tufts 130, 150 are located between the third and fourth conical tufts 160, 170 such that the conical tufts 130, 150, 160, 170 collectively form a cruciform arrangement (if a line was drawn to connect the first and second conical tufts 130, 150 and a separate line was drawn to connect the third and fourth conical tufts 160, 170, the result would be a cruciform shape).

In one embodiment, the first bristle wall 135 has a first thickness measured from the inner surface 131 of the first conical tuft 130 to the outer surface 136 of the first conical tuft 130. The second bristle wall 145 has a second thickness measured from the inner surface 141 of the second conical tuft 140 to the outer surface 146 of the second conical tuft 140. The third bristle wall 155 has a third thickness measured from the inner surface 151 of the third conical tuft 150 to the outer surface 156 of the third conical tuft 150. The fourth bristle wall 165 has a fourth thickness measured from the inner surface 161 of the fourth conical tuft 160 to the outer surface 166 of the fourth conical tuft 160. In one embodiment, the first and second thickness are substantially the same and the third and fourth thicknesses are substantially the same. Furthermore, in some embodiments the first and second thicknesses are greater than the third and fourth thicknesses, which renders the first and second conical tufts 130, 140 more rigid than the third and fourth conical tufts 150, 160. Furthermore, in some embodiments the first and second conical tufts 130, 140 may have an outer diameter that is substantially the same and the third and fourth conical tufts 150, 160 may have an outer diameter that is substantially the same, the outer diameter of the first and second conical tufts 130, 140 being greater than the outer diameter of the third and fourth conical tufts 150, 160.

In addition to the above, the plurality of tooth cleaning elements 115 also include a first set of distal tooth cleaning elements 220 arranged about a first loop 221 that surrounds the third conical tuft 160. The first set of distal tooth cleaning elements 220 comprises a grouping of tooth cleaning elements of various shapes and/or sizes that surround the third conical tuft 160. Specifically, the first set of distal tooth cleaning elements 220 comprises two arcuate tufts 222*a*, 222*b* at the distal-most portion of the head 110 that form the distal-most tooth cleaning elements on the head 110 and five rectangular (or otherwise four-sided) shaped tufts arranged in the loop 221 and extending from one of the two arcuate tufts 222*a*, 222*b* to the other of the two arcuate tufts 222*a*, 222*b*. In the exemplified embodiment, there are two arcuate tufts 222*a*, 222*b* that are spaced apart by a gap that is located on the longitudinal axis B-B, and thus the two arcuate tufts 222*a*, 222*b* are located on opposite sides of the longitudinal axis B-B. In other embodiments, the two arcuate tufts 222*a*, 222*b* can be combined into a single arcuate tuft at the distal end 119 of the head 110 that traverses over the longitudinal axis B-B.

The arcuate tufts 222*a*, 222*b* at the distal-most portion of the head 110 have larger cross-sectional areas than any of the other tufts in the loop 221. More specifically, the arcuate tufts 222*a*, 222*b* at the distal-most portion of the head 110 have the largest cross-sectional area of the tufts in the loop 221, the two tufts 223*a*, 223*b* that are immediately adjacent to each of the arcuate tufts 222*a*, 222*b* at the distal-most portion of the head 110 have the second largest cross-sectional area of the tufts in the loop 221, and the three tufts 224*a*, 224*b*, 224*c* positioned adjacent to the first arcuate tooth cleaning element 180 have the smallest cross-sectional area.

Thus, the two arcuate tufts 222*a*, 222*b* located between the third conical tuft 160 and the distal end 119 of the head 110 have a first transverse cross-sectional area, the two tufts 223*a*, 223*b* located between the third conical tuft 160 and the first and second lateral side edges 103, 104 of the head 110 have a second transverse cross-sectional area, and the three tufts 224*a*, 224*b*, 224*c* located between the third conical tuft 160 and the first arcuate tooth cleaning element 180 have a third transverse cross-sectional area. Furthermore, the first transverse cross-sectional area is greater than the second transverse cross-sectional area and the second transverse cross-sectional area is greater than the third transverse cross-sectional area.

Each of the tufts in the loop 221 is a separate and distinct tuft that is positioned within a separate tuft hole in the head 110. Thus, the tufts are spaced apart along the loop 221. Although the first set of distal tooth cleaning elements 220 are described as forming a loop that surrounds the third conical tuft 160, it should be appreciated that the loop has gaps therein in between each adjacent tuft of the first set of distal tooth cleaning elements 220.

The plurality of tooth cleaning elements 115 also include a second set of proximal tooth cleaning elements 230 arranged about a second loop 231 that surrounds the fourth conical tuft 170. The second set of proximal tooth cleaning elements 230 comprises a grouping of tooth cleaning elements of various shapes and/or sizes that surround the fourth conical tuft 170. Specifically, the second set of proximal tooth cleaning elements 230 comprises two arcuate tufts 232*a*, 232*b* at the proximal-most portion of the head 110 that form the proximal-most tooth cleaning elements on the head 110 and five rectangular (or otherwise four-sided) shaped tufts arranged in the loop 231 and extending from one of the two arcuate tufts 232*a*, 232*b* to the other of the two arcuate tufts 232*a*, 232*b*. In the exemplified embodiment, there are two arcuate tufts 232*a*, 232*b* that are spaced apart by a gap that is located on the longitudinal axis B-B, and thus the two arcuate tufts 232*a*, 232*b* are located on opposite sides of the longitudinal axis B-B. In other embodiments, the two arcuate tufts 232*a*, 232*b* can be combined into a single arcuate tuft at the distal end 119 of the head 110 that traverses over the longitudinal axis B-B.

The arcuate tufts 232*a*, 232*b* at the proximal-most portion of the head 110 have larger cross-sectional areas than any of the other tufts in the loop 231. More specifically, the arcuate tufts 232*a*, 232*b* at the proximal-most portion of the head 110 have the largest cross-sectional area of the tufts in the loop 231, the two tufts 233*a*, 233*b* that are immediately adjacent to each of the arcuate tufts 232*a*, 232*b* at the proximal-most portion of the head 110 have the second largest cross-sectional area of the tufts in the loop 231, and the three tufts 234*a*, 234*b*, 234*c* positioned adjacent to the second arcuate tooth cleaning element 190 have the smallest cross-sectional area.

Thus, the two arcuate tufts 232*a*, 232*b* located between the fourth conical tuft 170 and the proximal end 118 of the head 110 have a first transverse cross-sectional area, the two tufts 233*a*, 233*b* located between the fourth conical tuft 170 and the first and second lateral side edges 103, 104 of the head 110 have a second transverse cross-sectional area, and the three tufts 234*a*, 234*b*, 234*c* located between the fourth conical tuft 170 and the second arcuate tooth cleaning element 190 have a third transverse cross-sectional area. Furthermore, the first transverse cross-sectional area is greater than the second transverse cross-sectional area and the second transverse cross-sectional area is greater than the third transverse cross-sectional area.

Each of the tufts in the loop 231 is a separate and distinct tuft that is positioned within a separate tuft hole in the head 110. Thus, the tufts are spaced apart along the loop 231. Although the second set of proximal tooth cleaning elements 230 are described as forming a loop that surrounds the fourth conical tuft 170, it should be appreciated that the loop has gaps therein in between each adjacent tuft of the second set of proximal tooth cleaning elements 230.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle, the head comprising a front surface and a longitudinal axis that extends from a proximal end of the head to a distal end of the head;

a plurality of tooth cleaning elements extending from the front surface of the head;

the plurality of tooth cleaning elements comprising a first conical tuft comprising a first bristle wall having an inner surface defining a first cavity along a first cavity axis, the first cavity having a transverse cross-sectional area that increases with distance from the front surface of the head, wherein the first bristle wall of the first conical tuft terminates in a first annular top surface that is inclined relative to the front surface from a first high point to a first low point;

the plurality of tooth cleaning elements comprising a second conical tuft comprising a second bristle wall having an inner surface defining a second cavity along a second cavity axis, the second cavity having a transverse cross-sectional area that increases with distance from the front surface of the head, wherein the second bristle wall of the second conical tuft terminates in a second annular top surface that is inclined relative to the front surface from a second high point to a second low point; and the first and second conical tufts arranged on the head such that the first and second high points are adjacent to one another.

2. The oral care implement according to claim 1 wherein a transverse reference plane that is substantially perpendicular to the longitudinal axis and perpendicular to the front surface of the head intersects the first and second high points and the first and second low points.

3. The oral care implement according to claim 2 wherein each of the first and second annular top surfaces has a linear side profile when viewed from the transverse reference plane.

4. The oral care implement according to claim 2 wherein each of the first and second annular top surfaces slope downwardly with increasing distance from a longitudinal reference plane that is parallel with the longitudinal axis and perpendicular to the front surface.

5. The oral care implement according to claim 1 wherein the first and second conical tufts are located on opposite sides of the longitudinal axis.

6. The oral care implement according to claim 1 further comprising:

the plurality of tooth cleaning elements comprising a first central cleaning element located in the first central cavity, the first central cleaning element terminating in a free end at a height above the first high point and above the first low point; and the plurality of tooth cleaning elements comprising a second central cleaning element located in the second central cavity, the second central cleaning element terminating in a free end at a height above the second high point and above the second low point.

7. The oral care implement according to claim 1 wherein each of the first and second conical tufts extends from a single tuft hole.

8. The oral care implement according to claim 1 further comprising:

the plurality of tooth cleaning elements comprising a first arcuate tooth cleaning element having a first convex side surface and a first concave side surface, the first arcuate tooth cleaning positioned adjacent the first and second conical tufts so that the first convex side surface faces the first and second conical tufts;

the plurality of tooth cleaning elements comprising a second arcuate tooth cleaning element having a second convex side surface and a second concave side surface, the second arcuate tooth cleaning positioned adjacent the first and second conical tufts so that the second convex side surface faces the first and second conical tufts; and the first and second arcuate tooth cleaning elements are located on opposite sides of the first and second conical tufts.

9. The oral care implement according to claim 8 wherein each of the first and second arcuate tooth cleaning elements are formed of elastomer and are located on the longitudinal axis.

10. The oral care implement according to claim 1 further comprising:

the plurality of tooth cleaning elements comprising a third conical tuft comprising a third bristle wall having an inner surface defining a third cavity along a third cavity axis, the third cavity having a transverse cross-sectional area that increases with distance from the front surface of the head;

the plurality of tooth cleaning elements comprising a fourth conical tuft comprising a fourth bristle wall having an inner surface defining a fourth cavity along a fourth cavity axis, the fourth cavity having a transverse cross-sectional area that increases with distance from the front surface of the head; and the third and fourth conical tufts located on the longitudinal axis.

11. The oral care implement according to claim 10 further comprising:

the plurality of tooth cleaning elements comprising a first set of distal tooth cleaning elements arranged about a first loop that surrounds the third conical tuft; and the plurality of tooth cleaning elements comprising a second set of proximal tooth cleaning elements arranged about a second loop that surrounds the third conical tuft.

12. The oral care implement according to claim 1 further comprising:

the plurality of tooth cleaning elements comprising first and second peripheral tooth cleaning elements located along a first lateral edge of the head, the first conical tuft located between the first and second peripheral tooth cleaning elements; and the plurality of tooth cleaning elements comprising third and fourth peripheral tooth cleaning elements located along a second lateral edge of the head, the second conical tuft located between the third and fourth peripheral tooth cleaning elements.

13. The oral care implement according to claim 1 wherein each of the first, second, third, and fourth conical tufts extend from a single tuft hole and are secured to the head by anchor free tufting.

14. An oral care implement comprising:

a handle;

a head coupled to the handle, the head comprising a front surface and a longitudinal axis that extends from a proximal end of the head to a distal end of the head;

a plurality of tooth cleaning elements extending from the front surface of the head;

the plurality of tooth cleaning elements comprising a first conical tuft comprising a first bristle wall having an inner surface defining a first cavity along a first cavity axis, the first cavity having a transverse cross-sectional area that increases with distance from the front surface of the head;

the plurality of tooth cleaning elements comprising a second conical tuft comprising a continuous bristle wall having an inner surface defining a second cavity along a second cavity axis, the second cavity having a transverse cross-sectional area that increases with distance from the front surface of the head; and the first and second conical tufts arranged on a transverse axis of the head that is perpendicular to the longitudinal axis;

the plurality of tooth cleaning elements comprising a third conical tuft comprising a third bristle wall having an inner surface defining a third cavity along a third cavity axis, the third cavity having a transverse cross-sectional area that increases with distance from the front surface of the head;

the plurality of tooth cleaning elements comprising a fourth conical tuft comprising a fourth bristle wall having an inner surface defining a fourth cavity along a fourth cavity axis, the fourth cavity having a transverse cross-sectional area that increases with distance from the front surface of the head; and the third and fourth conical tufts located on the longitudinal axis of the head.

15. The oral care implement according to claim 14 wherein the first and second conical tufts are located between the third and fourth conical tufts to collectively form a cruciform arrangement.

16. The oral care implement according to claim 14 further comprising:

the plurality of tooth cleaning elements comprising a first set of distal tooth cleaning elements arranged about a first loop that surrounds the third conical tuft; and the plurality of tooth cleaning elements comprising a second set of proximal tooth cleaning elements arranged about a second loop that surrounds the third conical tuft.

17. The oral care implement according to claim 14 further comprising:

the plurality of tooth cleaning elements comprising first and second peripheral tooth cleaning elements located along a first lateral edge of the head, the first conical tuft located between the first and second peripheral tooth cleaning elements; and the plurality of tooth cleaning elements comprising third and fourth peripheral tooth cleaning elements located along a second lateral edge of the head, the second conical tuft located between the third and fourth peripheral tooth cleaning elements.

18. The oral care implement according to claim 14 further comprising:

the plurality of tooth cleaning elements comprising a first arcuate tooth cleaning element having a first convex side surface and a first concave side surface, the first arcuate tooth cleaning positioned adjacent the first and second conical tufts so that the first convex side surface faces the first and second conical tufts;

the plurality of tooth cleaning elements comprising a second arcuate tooth cleaning element having a second convex side surface and a second concave side surface, the second arcuate tooth cleaning positioned adjacent the first and second conical tufts so that the second convex side surface faces the first and second conical tufts;

the first and second arcuate tooth cleaning elements are located on opposite sides of the first and second conical tufts on the longitudinal axis, the first arcuate tooth cleaning element positioned between the first and second conical tufts and the third conical tuft, and the second arcuate tooth cleaning element positioned between the first and second conical tufts and the fourth conical tuft.

19. An oral care implement comprising:

a handle;

a head coupled to the handle, the head comprising a front surface and a longitudinal axis that extends from a proximal end of the head to a distal end of the head;

a plurality of tooth cleaning elements extending from the front surface of the head; and the plurality of tooth cleaning elements comprising a first conical tuft comprising a first bristle wall having an inner surface defining a first cavity along a first cavity axis, the first cavity having a transverse cross-sectional area that increases with distance from the front surface of the head, wherein the first bristle wall of the first conical tuft terminates in a first annular top surface that is inclined relative to the front surface from a first high point to a first low point.

20. The oral care implement according to claim 19 wherein a transverse reference plane that is substantially perpendicular to the longitudinal axis and perpendicular to the front surface of the head intersects the first high point and the first low point, wherein the first annular top surface has a linear side profile when viewed from the transverse reference plane, and wherein the first annular top surface slopes downwardly with increasing distance from a longitudinal reference plane that is parallel with the longitudinal axis and perpendicular to the front surface.

* * * * *